US009125436B2

(12) United States Patent
Nappi

(10) Patent No.: US 9,125,436 B2
(45) Date of Patent: Sep. 8, 2015

(54) VENTILATED SMOKING ARTICLE

(75) Inventor: Leonardo Nappi, London (GB)

(73) Assignee: British American Tobacco (Investments) Limited, London (GB)

( * ) Notice: Subject to any disclaimer, the term of this patent is extended or adjusted under 35 U.S.C. 154(b) by 0 days.

(21) Appl. No.: 13/882,481

(22) PCT Filed: Oct. 27, 2011

(86) PCT No.: PCT/EP2011/068886
§ 371 (c)(1), (2), (4) Date: May 20, 2013

(87) PCT Pub. No.: WO2012/055977
PCT Pub. Date: May 3, 2012

(65) Prior Publication Data

US 2013/0228189 A1 Sep. 5, 2013

(30) Foreign Application Priority Data

Oct. 29, 2010 (GB) ..... 1018310.1

(51) Int. Cl.
*A24D 1/02* (2006.01)
*A24C 5/00* (2006.01)

(52) U.S. Cl.
CPC ..... *A24D 1/027* (2013.01); *A24C 5/005* (2013.01)

(58) Field of Classification Search
CPC ..... A24C 5/007; A24C 5/005; A24C 5/60; A24C 5/606; A24C 5/607
See application file for complete search history.

(56) References Cited

U.S. PATENT DOCUMENTS

| | | | | |
|---|---|---|---|---|
| 2,981,261 | A * | 4/1961 | Rupert | 131/336 |
| 3,228,402 | A | 1/1966 | Lebert | |
| 3,291,136 | A | 12/1966 | Boyer | |
| 3,606,892 | A | 9/1971 | Wilson | |
| 2004/0003822 | A1 * | 1/2004 | Atindranath | 131/364 |
| 2004/0231685 | A1 | 11/2004 | Patel et al. | |
| 2009/0301506 | A1 | 12/2009 | Kida et al. | |

FOREIGN PATENT DOCUMENTS

| | | | |
|---|---|---|---|
| CH | 356394 | * | 8/1961 |
| DE | 1136921 | B | 9/1962 |
| EP | 0 325 920 | A1 | 8/1989 |
| EP | 0 325 921 | A1 | 8/1989 |
| EP | 0 880 905 | A1 | 12/1998 |
| EP | 1 475 003 | A1 | 11/2004 |
| EP | 2 143 345 | A1 | 1/2010 |

(Continued)

OTHER PUBLICATIONS

Jensen & Son, "Improvements Relating to Cigarettes" (Embossed Cigarette Paper), Jul. 17, 1969 (Date Added to UCSF Mar. 10, 2011), British American Tobacco. Accessed via: http://legacy.library.ucsf.edu/tid/vha08h99.*

(Continued)

*Primary Examiner* — Michael J Felton
(74) *Attorney, Agent, or Firm* — N W Poulsen; L A Pinol

(57) ABSTRACT

A smoking article comprising a rod of smokeable material (3) and a wrapper (4) wrapped around the rod of smokeable material, wherein the wrapper comprises a region of ventilation embossing (9) overlapping the smokeable material. A manufacturing method and apparatus are also described.

25 Claims, 4 Drawing Sheets

(56) References Cited

FOREIGN PATENT DOCUMENTS

| | | | | |
|---|---|---|---|---|
| FR | 2860688 | A1 | | 4/2005 |
| GB | 873961 | | * | 8/1961 |
| GB | 875252 | A | | 8/1961 |
| GB | 1 277 443 | | | 6/1972 |
| GB | 1 524 211 | | | 9/1978 |
| WO | 2007/113693 | A2 | | 10/2007 |
| WO | 2008/072523 | A1 | | 6/2008 |
| WO | 2009/037304 | A1 | | 3/2009 |
| WO | 2009/141217 | A1 | | 11/2009 |
| WO | 2011/117106 | A1 | | 9/2011 |

OTHER PUBLICATIONS

Ward, MJ, "Supplement to Search on Ventilated Mouthpieces to include also lain or Mouthpieces Cigarettes with Vents at the Mouthend of the Tobacco Rod", British American Tobacco, Legacy Tobacco Documents Library, http://legacy.library.ucsf.edu/tid/bxd42a99 accessed on Dec. 9, 2014.*

Search Report and Written Opinion, mailed Feb. 6, 2012, for PCT Application No. PCT/EP2011/068886, filed Oct. 27, 2011.

Written Opinion, mailed Oct. 29, 2012, for PCT Application No. PCT/EP2011/068886, filed Oct. 27, 2011.

International Preliminary Report on Patentability, mailed Feb. 7, 2013, for PCT Application No. PCT/EP2011/068886, filed Oct. 27, 2011.

Search Report and Written Opinion, mailed Jul. 28, 2011, for PCT Application No. PCT/EP2011/053855, filed Mar. 15, 2011.

Second Office Action, issued Dec. 2, 2014 by State Intellectual Property Office, P.R. China, for Chinese Patent Application No. 201180051926.8, filed Oct. 27, 2011.

Search Report dated Nov. 24, 2014 by State Intellectual Property Office, P.R. China, for Chinese Patent Application No. 201180051926.8, filed Oct. 27, 2011.

* cited by examiner

VENTILATED SMOKING ARTICLE

CLAIM FOR PRIORITY

This application is a National Stage Entry entitled to and hereby claims priority under 35 U.S.C. §§365 and 371 to corresponding PCT Application No. PCT/EP2011/068886, filed Oct. 27, 2011, which in turn claims priority to GB Application No. 1018310.1, filed Oct. 29, 2010. The entire contents of the aforementioned applications are herein expressly incorporated by reference.

FIELD OF THE INVENTION

The invention relates to a ventilated smoking article. Particularly, but not exclusively, the invention relates to a smoking article which is ventilated via an embossed region in a wrapper wrapped around a smokeable material rod.

BACKGROUND TO THE INVENTION

As used herein, the term "smoking article" includes smokeable products such as cigarettes, cigars and cigarillos whether based on tobacco, tobacco derivatives, expanded tobacco, reconstituted tobacco or tobacco substitutes and also heat-not-burn products.

The non-porous tipping paper of a conventional filter cigarette often includes ventilation holes at a location which overlaps the filter. The holes allow air to be drawn into the filter during smoking to dilute the smoke exiting the mouth end of the smoking article. The holes are of relatively large diameter and are generally formed by perforating the tipping paper and the plugwrap paper by passing the filter under a pulsing laser beam. Another option is to use a pre-perforated tipping paper coupled with a porous plugwrap paper. An example of a pre-perforated tipping paper and a porous plugwrap paper is shown in FIGS. 1 and 2.

Generally a filter cigarette also includes a substantially homogeneous and porous cigarette paper, which bounds a rod of smokeable material such as tobacco. The porous nature of the cigarette paper allows a degree of gaseous exchange between the smokeable material and the exterior of the paper. However, the volume of gaseous exchange through the cigarette paper significantly reduces as the length of the rod of smokeable material, and therefore the surface area of the cigarette paper, reduces during smoking. There is therefore significant puff-by-puff variation in the dilution of the smoke entering the filter from the rod of smokeable material. Dilution can reduce significantly from the first puff to the last.

SUMMARY OF THE INVENTION

According to the invention, there is provided a smoking article comprising a rod of smokeable material and a wrapper wrapped around the rod of smokeable material, wherein the wrapper comprises at least one region of ventilation embossing overlapping the smokeable material.

The region of ventilation embossing may be located in a quarter of the wrapper which is closest to a mouth end of the rod.

The region of ventilation embossing may be located in a third of the wrapper which is closest to a mouth end of the rod.

The region of ventilation embossing may be located in a half of the wrapper which is closest to a mouth end of the rod.

The gas diffusivity of the region of ventilation embossing may be higher than the gas diffusivity of a remainder of the wrapper.

The gas diffusivity may be the carbon dioxide ($CO_2$) diffusivity.

The gas diffusivity of the region of ventilation embossing may be at least 0.80 cm/s.

The gas diffusivity of the region of ventilation embossing may be at least three times greater than the gas diffusivity of the remainder of the wrapper.

The gas diffusivity of the region of ventilation embossing may be at least five times greater than the gas diffusivity of the remainder of the wrapper.

The gas diffusivity of the region of ventilation embossing may be at least eight times greater than the gas diffusivity of the remainder of the wrapper.

The gas diffusivity of the region of ventilation embossing may be at least ten times greater than the gas diffusivity of the remainder of the wrapper.

The permeability of the region of ventilation embossing may be higher than the permeability of a remainder of the wrapper.

The permeability of the region of ventilation embossing may be between 30 CU and 75 CU.

The permeability of the region of ventilation embossing may be between 50 CU and 100 CU.

The permeability of the region of ventilation embossing may be between 100 CU and 200 CU.

The permeability of the remainder of the wrapper may be between 1 CU and 20 CU.

The permeability of the remainder of the wrapper may be between 20 CU and 30 CU.

The permeability of the remainder of the wrapper may be between 30 CU and 45 CU.

The permeability of the remainder of the wrapper may be between 30 CU and 60 CU.

The permeability of the region of ventilation embossing may be approximately 50 CU and the permeability of the remainder of the wrapper may be approximately 10 CU.

The permeability of the region of ventilation embossing may be approximately 100 CU and the permeability of the remainder of the wrapper may be approximately 25 CU.

The permeability of the region of ventilation embossing may be approximately 150 CU and the permeability of the remainder of the wrapper may be approximately 50 CU.

The permeability of the region of ventilation embossing may be at least one and a half times greater than the permeability of the remainder of the wrapper.

The permeability of the region of ventilation embossing may be at least twice the permeability of the remainder of the wrapper.

The permeability of the region of ventilation embossing may be at least three times greater than the permeability of the remainder of the wrapper.

The permeability of the region of ventilation embossing may be at least five times greater than the permeability of the remainder of the wrapper.

The region of ventilation embossing may cover 60% or less of the external surface of the wrapper.

The region of ventilation embossing may cover 40% or less of the external surface of the wrapper.

The region of ventilation embossing may cover 30% or less of the external surface of the wrapper.

The region of ventilation embossing may cover 20% or less of the external surface of the wrapper.

The region of ventilation embossing may cover 10% or less of the external surface of the wrapper.

The smoking article may comprise a filter attached to a mouth end of the rod of smokeable material.

The region of ventilation embossing may be configured to ventilate the filter via external gas entering the rod through the region of ventilation embossing and being drawn into the filter.

The smoking article may comprise a tipping paper which does not comprise vent holes.

The wrapper may be a cigarette paper.

According to the invention, there is also provided a method of forming a smoking article comprising, embossing a ventilation region in a smoking article wrapper and wrapping the wrapper around a rod of smokeable material such that the ventilation region overlaps the smokeable material.

According to the invention, there is also provided a smoking article assembly unit configured to emboss a ventilation region in a smoking article wrapper and wrap the wrapper around a rod of smokeable material such that the ventilation region overlaps the smokeable material.

BRIEF DESCRIPTION OF THE FIGURES

Embodiments of the invention are described below with reference to the accompanying figures, in which.

DETAILED DESCRIPTION OF THE INVENTION

Figure 3:
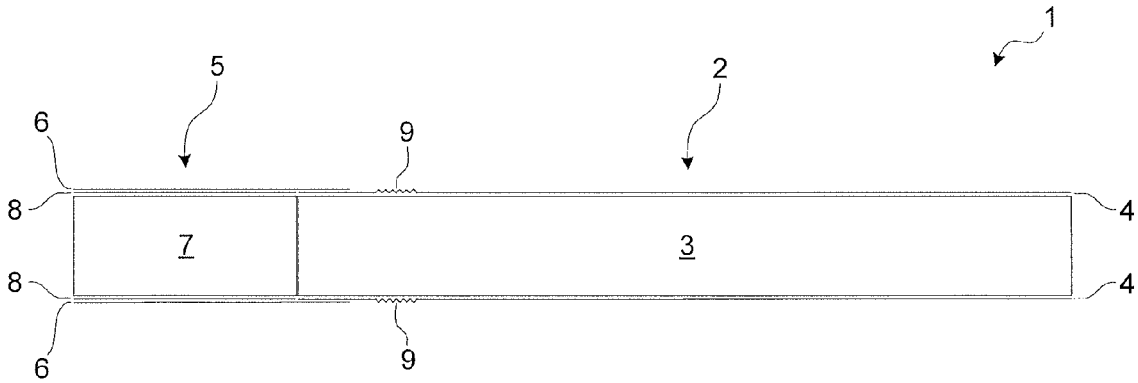
FIG. 3 is a cross-sectional illustration of a cigarette comprising a smokeable material rod wrapped in a cigarette paper having a region of ventilation embossing close to the mouth end.

FIG. 3 illustrates a cigarette 1 comprising a rod of smokeable material 2. The rod of smokeable material 2 comprises a substantially cylindrical core of smokeable material 3 such as tobacco and a wrapper 4 wrapped around the longitudinal surface of the core 3. The ends of the core 3 are open. The tobacco may comprise at least one of tobacco leaf, tobacco stem and reconstituted tobacco.

The cigarette 1 also comprises a filter 5 and a tipping paper 6 joining the filter 5 to the rod of smokeable material 2. The filter 5 comprises a substantially cylindrical plug of filter material 7 comprising cellulose acetate tow. Subject to regulatory approval, the plug 7 may also comprise other materials such as suitable flavourants. Any known type of filter plug 7 can be used. The filter 5 may also comprise a porous plug wrap 8 wrapped around the longitudinal surface of the filter plug 7. The plug wrap 8 may be held in place around the filter plug 7 by gluing along a seam of overlapping material using a suitable adhesive.

Referring to FIG. 3, the tipping paper 6 overlaps the filter 5 and a region of the rod of smokeable material 2 to axially join the filter 5 to the rod 2. For example, a suitable adhesive material may be provided between the inner surface of the tipping paper 6 and the external surfaces of the filter 5 and the rod 2 to secure the tipping paper 6 in place. The tipping paper 6 may be substantially non-porous. However, optionally, one or more conventional vent holes may be formed in the tipping paper 6 overlapping the filter core 7, for example in a circumferential ring, using a laser or by pre-perforating the paper 6. Alternatively, as is explained below, the conventional vent holes may be omitted.

Figure 4:
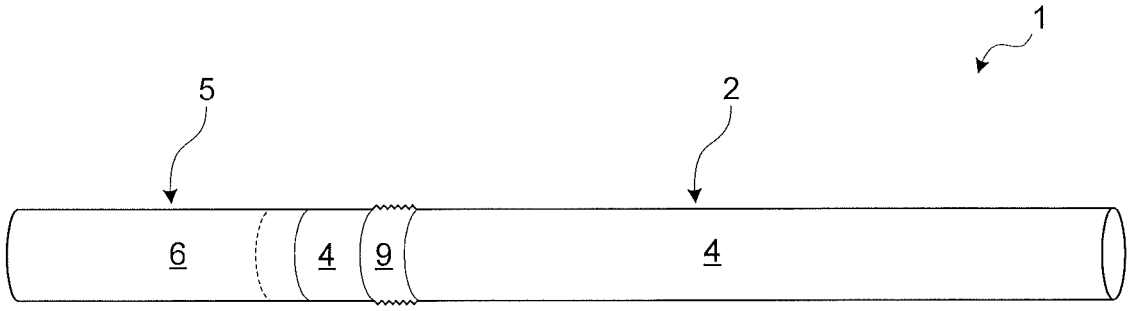
FIG. 4 is a perspective illustration of the cigarette shown in FIG. 3.

The end faces of the rod 2 and the filter 5 may abut each other, as shown in FIG. 3. This is also shown in FIG. 4 by the location of the dotted line.

The wrapper 4 around the core of smokeable material 3 comprises a base paper and is discussed below in the context of a cigarette paper. Referring to FIGS. 3 and 4, the wrapper 4 comprises a region of ventilation embossing 9 which, for a particular pressure drop, is configured to allow a higher rate of gaseous exchange between the core of smokeable material 3 and the exterior of the rod 2 than the rate of gaseous exchange through an equivalent area of the remainder of the wrapper 4. The smokeable material 2 is therefore ventilated by a region of embossing 9 in the wrapper 4.

The ventilation embossing 9 constitutes a diffusion zone through which gas molecules in the mainstream smoke can diffuse out of the cigarette 1. The diffusion of gaseous smoke components out of the rod 2 causes a reduction in the number of gaseous smoke components which enter the filter 5 during puffing. Examples of such gaseous phase components are Carbon Monoxide and Nitrogen Oxide.

Similarly, the ventilation embossing 9 constitutes a diffusion zone through which gas molecules, such as Oxygen, in the air surrounding the cigarette 1 can diffuse into the smokeable material rod 2. External air which diffuses into the smokeable material core 3 mixes with the mainstream smoke and, during puffing, is drawn into the filter 5 with the mainstream smoke. The mainstream smoke is thereby diluted before the smoke enters the filter 5.

The permeability of the wrapper 4 in the region of ventilation embossing 9 is greater than the permeability of the remainder of the wrapper 4. Additionally, the gas diffusivity of the wrapper 4 in the region of ventilation embossing 9 is greater than the gas diffusivity of the remainder of the wrapper 4. The remainder of the wrapper 4 may be substantially homogeneous and not embossed, as shown in FIGS. 3 and 4.

For example, the wrapper 4 may comprise a region of ventilation embossing 9 having a permeability of between 45 CU and 55 CU, such as approximately 50 CU. The remainder of the wrapper 4 may have a permeability of between 5 and 15 CU, such as approximately 10 CU. Alternatively, the region of ventilation embossing 9 may have a permeability of between 95 CU and 105 CU, such as approximately 100 CU, whilst the remainder of the wrapper 4 has a permeability of between 20 CU and 30 CU, such as approximately 25 CU. In general terms, the permeability of the region of ventilation embossing 9 may be any value between approximately 30 CU and approximately 200 CU. For example, any value between 40 CU and 150 CU, 50 CU and 120 CU or 70 CU and 100 CU.

The permeability of the region of ventilation embossing 9 may be at least twice the permeability of the remainder of the wrapper 4. For example, the permeability of the ventilation embossing 9 may be approximately three, four, five, six, seven, eight, nine or ten times greater than the permeability of the remainder of the wrapper 4. The permeability of the region of ventilation embossing 9 may also be less than twice the permeability of the remainder of the wrapper 4.

Figure 5:
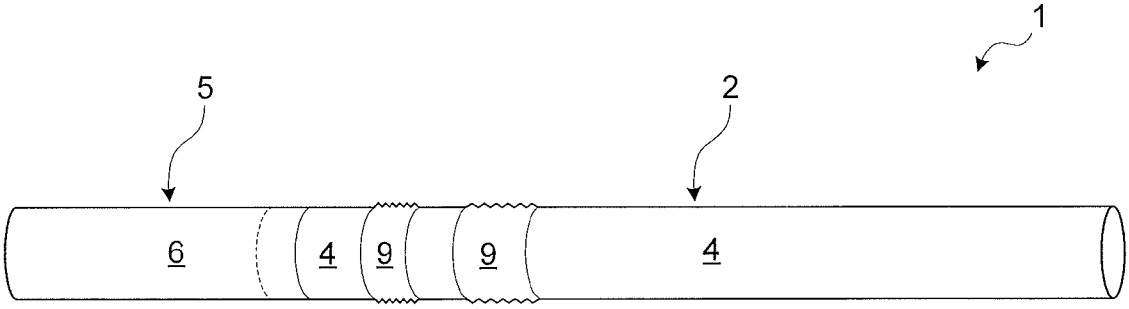
FIG. 5 is a perspective illustration of a cigarette comprising a smokeable material rod wrapped in a cigarette paper having a downstream region of ventilation embossing and an upstream region of ventilation embossing separated from the downstream region by a non-embossed region of the paper.

The region of ventilation embossing 9 can optionally be divided over two or more discrete areas of the wrapper 4 separated by areas of non-embossed wrapper 4. The permeability and/or gas diffusivity and/or size of each of the areas of ventilation embossing 9 may be different. For example, referring to FIG. 5, the wrapper 4 can comprise a first region of ventilation embossing 9 having a permeability of between 95 CU and 105 CU, such as approximately 100 CU, and a second region of ventilation embossing 9 having a permeability of between 70 CU and 80 CU, such as approximately 75 CU. The regions of embossing 9 are separated from each other by regions of the wrapper 4 which are non-embossed. The first region of embossing 9 may be closer to the mouth/filter end of the rod 2 than the second region of embossing 9. For example, as shown in FIG. 5, starting from the mouth/filter end and moving longitudinally along the rod 2, the wrapper 4 can comprise a first region of non-embossed wrapper 4, the first (downstream) region of ventilation embossing 9, a second region of non-embossed wrapper 4, the second (upstream) region of ventilation embossing 9 and a third region of non-embossed wrapper 4. Optionally, the first region of non-embossed wrapper 4 can be omitted such that the first region of ventilation embossing 9 is located immediately adjacent the tipping paper 6.

The $CO_2$ diffusivity of the wrapper 4 in the region of ventilation embossing 9 may be any value between approximately 0.60 cm/s and 3.00 cm/s, for example at least 0.80 cm/s or between 1.00 cm/s and 2.00 cm/s, when measured with a SODIM paper diffusivity meter. The inherent $CO_2$ diffusivity of the remainder of the wrapper 4 may be any value below 2.5 cm/s, such as any value between 0.20 cm/s and 1.80 cm/s, when measured with a SODIM paper diffusivity meter. The difference between the inherent $CO_2$ diffusivity of the wrapper 4 and the $CO_2$ diffusivity of the region of ventilation embossing 9 is representative of differences in gas diffusivity generally. For example, it is representative of differences in the diffusivity to CO, $O_2$, NO and other small volatile compounds. The $CO_2$ diffusivity of the region of ventilation embossing 9 may be at least two times greater than the $CO_2$ diffusivity of the remainder of the wrapper 4. For example, the $CO_2$ diffusivity of the ventilation embossing 9 may be approximately three, four, five, six, seven, eight, nine or ten times greater than the $CO_2$ diffusivity of the remainder of the wrapper 4. Alternatively, the $CO_2$ diffusivity of the region of ventilation embossing 9 may be less than twice the $CO_2$ diffusivity of the remainder of the wrapper 4.

The ventilation embossing 9 may be confined to the half of the wrapper 4 which is closest to the tipping paper 6 (at the mouth/filter end of the rod 2). The ventilation embossing 9 is preferably located close to the mouth/filter end of the rod 2, for example in the third, quarter, fifth, sixth, seventh, eighth, ninth or tenth of the wrapper 4 which is closest to the tipping paper 6.

The region of ventilation embossing 9 may occupy anywhere between approximately 5% and 60% of the wrapper 4, such as between 5% and 40%, depending on the desired level of mainstream smoke dilution and/or reduction in gas phase smoke components. Other percentages can also be used. The region 9 preferably comprises one or more circumferential bands as shown in FIGS. 4 and 5. The region 9 may be of any suitable shape. Optionally, to increase the strength of the join between the rod 2 and filter 5, the region of ventilation embossing 9 is not present underneath the tipping paper 6.

The significant difference between the permeability and gas diffusivity of the ventilation embossing 9 and the remainder of the wrapper 4 means that a significant majority of the dilution air entering the smokeable material core 3 through the wrapper 4 does so via the ventilation embossing 9. Similarly, a significant majority of the gas diffusing out of the rod 2 through the wrapper 4 does so via the ventilation embossing 9. The permeability of the remainder of the wrapper 4 can be lower than in conventional homogeneous wrappers to increase the percentage of dilution which occurs in the ventilation region 9.

The smoke dilution and reduction in gaseous smoke components therefore remains substantially constant during smoking until the burning end of the rod 2 reaches the ventilation embossing 9. This is because, due to the majority of the overall smoke dilution and reduction in gaseous smoke components being due to the region of ventilation embossing 9, burning the remainder of the wrapper 4 has little effect in terms of reducing the overall smoke dilution and gaseous smoke components.

Figure 1:
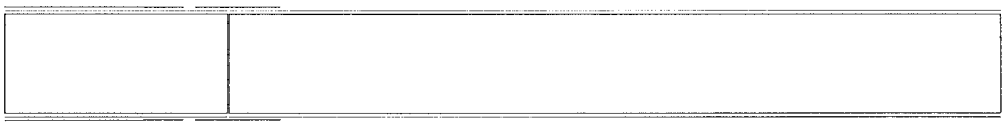
FIG. 1 is cross sectional illustration of a conventional filter cigarette comprising a smokeable material rod wrapped in homogeneous cigarette paper, a filter plug and a tipping paper comprising laser holes or pin perforations overlapping the filter plug.
Figure 2:
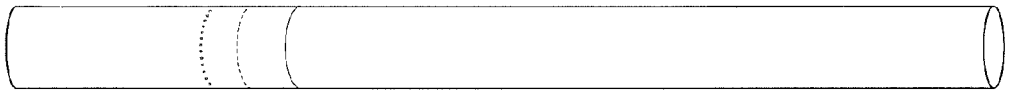
FIG. 2 is perspective illustration of the conventional filter cigarette shown in FIG. 1.

If the ventilation embossing 9 is positioned close to the tipping paper 6 end of the rod 2, as shown in FIGS. 3 to 5 for instance, the smoke dilution and diffusion of gaseous smoke components can remain substantially constant for all but the final puff(s). The puff-by-puff variation in smoke dilution and gaseous smoke components is therefore much less than when a conventional, substantially homogeneous wrapper similar to the type shown in FIGS. 1 and 2 is used. The wrapper 4 therefore provides a consistent smoking experience for the smoker.

As referred to above, gaseous air molecules entering the smokeable material core 3 via the ventilation embossing 9 significantly dilute the smoke immediately upstream from the filter 5. The gaseous air molecules are drawn into the filter plug 7 along with the remaining smoke components during puffing. An effect of the ventilation embossing 9 is therefore to ventilate the filter 5, meaning that the degree to which the filter 5 is ventilated by conventional means (such as pin or laser vent holes in the tipping paper 6) can be reduced (to achieve an equivalent ventilation level for the filter). Optionally, conventional ventilation means can be omitted. The gas diffusivity of the ventilation embossing 9 is much higher than that of a conventional perforated tipping paper of the type described above. In fact, forming laser or pre-perforated vent holes in a wrapper, as is conventional in tipping papers to ventilate filters in conventional cigarettes, does not substantially affect the gas diffusivity of the wrapper.

The cigarette 1 may be of any suitable dimensions. For example, the rod of smokeable material 2 may have a length of approximately 61 mm and a circumference of approximately 24.6 mm or 17.0 mm. The filter 5 may have a length of approximately 22 mm and a circumference substantially equal to that of the rod 2. The length of the sheet of overlying tipping paper 6 may be approximately 26 mm. The density of the core of smokeable material 3 may be approximately 240 $mg/cm^3$.

Figure 6:
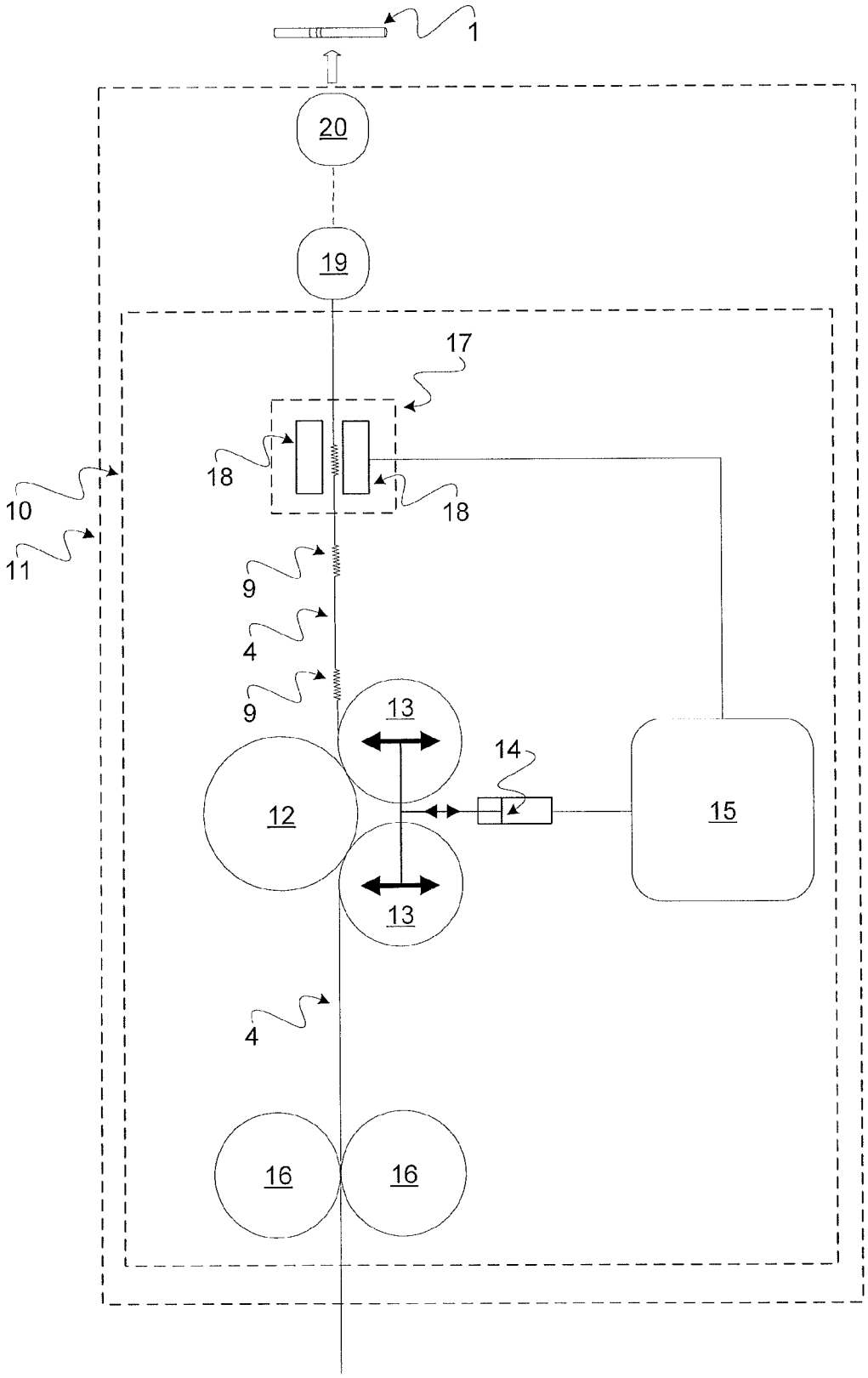
FIG. 6 is a schematic illustration of an embossing unit in a cigarette assembly apparatus.
Figure 7:
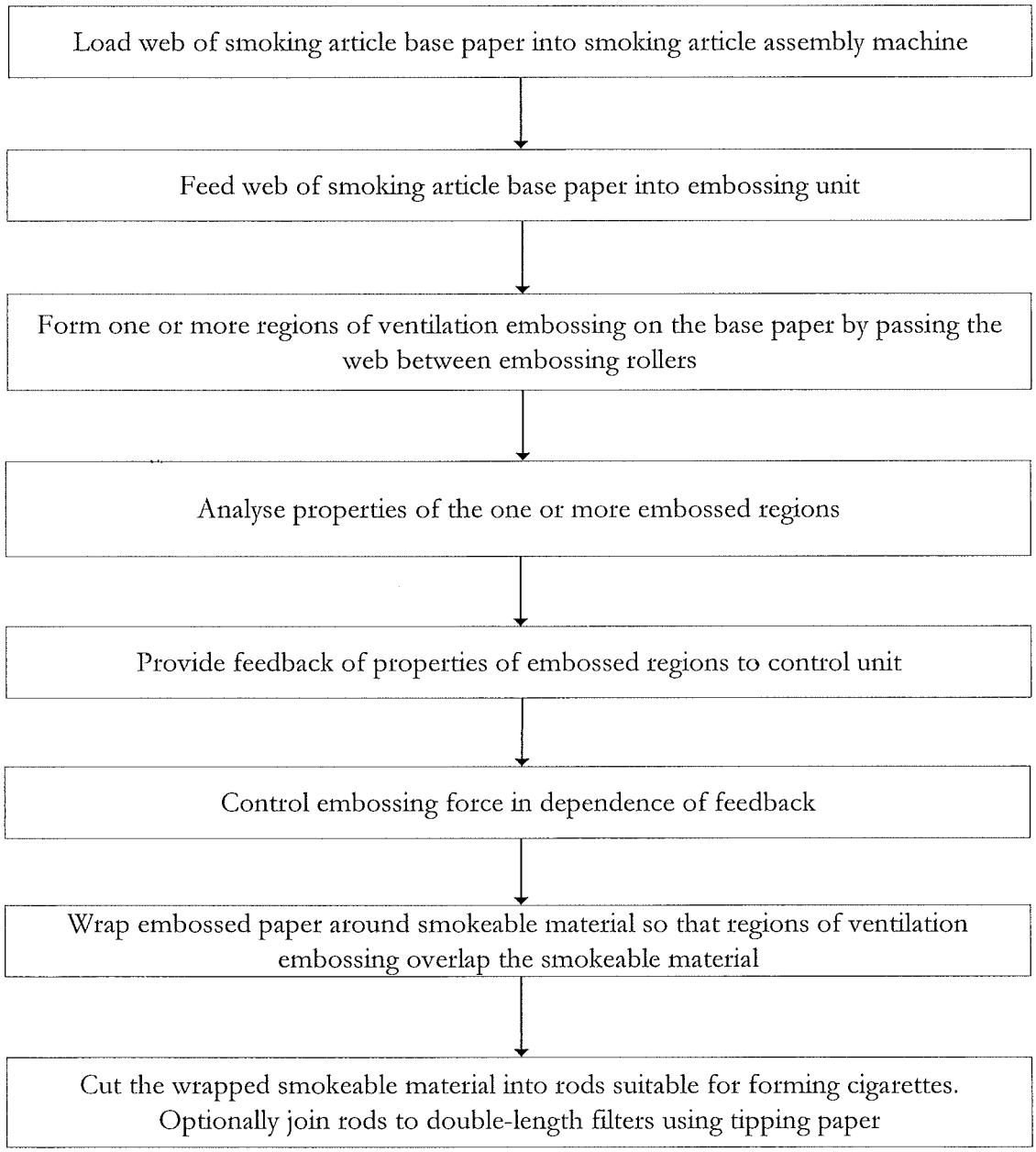
FIG. 7 is a flow diagram of a method of forming a smoking article having a region of ventilation embossing in a wrapper wrapped around a rod of smokeable material.

The wrapper 4 can be embossed in an embossing unit 10, which may be comprised in a cigarette or other smoking article assembly apparatus 11. An example of the embossing unit 10 is shown in FIG. 6. FIG. 7 is a flow diagram showing an example embossing method which may take place in the embossing unit 10. The embossing unit 10 comprises an embossing drive roller 12 and one or more embossing contrast rollers 13, which together emboss a web of base paper such as cigarette paper 4 as the paper web moves between the drive roller 12 and the contrast roller(s) 13. The width of the web of paper may be approximately 26.5 mm, which is sufficient to wrap around the circumference of the core of smokeable material 3 and provide a lap seam for gluing the wrapper 4 in place around the smokeable material core 3. The embossing rollers 12, 13 comprise an embossing pattern on their circumferential surface.

The circumferential surface of one or more of the embossing rollers 12, 13 may comprise a first region for forming the region of ventilation embossing 9 and a second region which is substantially smooth. The first region may be adapted to form a single area of ventilation embossing 9 or a plurality of discrete areas of ventilation embossing 9 as described above. The first region may comprise a set of embossing protrusions or projections, which extend substantially radially outwards from the circumferential surface of the roller 12, 13. The set of embossing protrusions may comprise a plurality of truncated pyramids having a base width of approximately 0.3 mm. The height of the pyramids may be approximately 0.15 mm, although this may vary in dependence of the properties of the base paper which is to be embossed.

The circumferential surface of the embossing contrast roller(s) 13 is forced against the circumferential surface of the embossing drive roller 12 by a pneumatic system comprising a piston 14. The force exerted on the paper 4 between the embossing rollers 12, 13 is proportional to the air or fluid pressure exerted against the piston 14 in the pneumatic system. Alternatively, a mechanical set-up could be employed in which a set of cams are used to control the relative positions of rollers 12, 13. The air or fluid pressure on the piston 14 can be varied by a control unit 15 which is configured to increase or decrease the air or fluid pressure in the pneumatic system according to a set of control parameters, which may be predetermined or may be adaptively determined according to the results of the embossing process. The diameter of the piston 14 may be approximately 2.75 inches. However, the diameter of the piston 14 can be reduced to provide greater control over the embossing force applied to the paper 4 by the embossing rollers 12, 13. The use of a smaller diameter piston 14 will result in a smaller increase in embossing force for a given increase in air or fluid pressure applied to the piston 14. A corresponding effect will be provided for decreases in air or fluid pressure. A suitable alternative diameter for the piston 14 may be approximately 1 inch.

The embossing unit 10 may also comprise one or more additional drive rollers 16 configured to drive the paper web 4 through the embossing unit 10. The drive rollers 16 may also be used to position the paper web 4 relative to the embossing rollers 12, 13 before embossing. For example, the paper web 4 may be advanced or retarded with respect to the position of the embossing rollers 12, 13 in dependence of a signal from a photocell in order to align a printed pattern on the web 4 with a predetermined position in the embossing unit 10. The additional drive rollers 16 may have a substantially smooth circumferential surface. In FIG. 6, a pair of such additional drive rollers 16 is provided in the paper path preceding the embossing rollers 12, 13.

The embossing unit 10 further comprises an analysis unit 17 which is configured to analyse the properties of the paper web 4 after it has passed between the embossing rollers 12, 13. The analysis unit 17 comprises one or more sensors 18, which may include the photocell referred to above, for collecting information about the structure of the embossed paper 4. The collected information may, for example, include one or more of the air permeability of the paper 4, the thickness of the paper 4 and the gas diffusivity of the paper 4, both in the region of ventilation embossing 9 and in the remainder of the paper 4.

As shown in FIG. 6, the analysis unit 17 is communicatively coupled to the control unit 15 to allow control signals to pass between the analysis unit 17 and the control unit 15. This communication may take place by any known means, for example via a wireless communication link. In this way, the control unit 15 may receive information from the analysis unit 17 regarding the properties of the embossed paper 4 and may use the information to adjust the force being exerted against the paper 4 by the embossing rollers 12, 13 and thereby attain/maintain the desired permeability and gas diffusivity levels in the region of ventilation embossing 9. The feedback mechanism provided by the above-described communication between the analysis unit 17 and the control unit 15 allows the embossing unit 10 to maintain embossing according to the control parameters being used.

The permeability and gas diffusivity of the region of ventilation embossing 9 can be selected by varying the force applied to the paper 4 during the embossing process. As such, the force applied to the paper web 4 as it passes between the embossing rollers 12, 13 can be varied in dependence of the exact properties which are desired for the wrapper 4.

A lap seam at either edge of the width of the paper web 4 may be left non-embossed in order to facilitate effective gluing of the wrapper 4 around the smokeable material core 3. This may be achieved by providing suitable smooth regions on the embossing rollers 12, 13 so that the web 4 is not embossed in the lap seam.

The embossing unit 10 described above is installed into a cigarette assembly machine 11 so that the embossing process takes place "on-line" as part of an integrated cigarette assembly process. This is possible because the embossing process can be carried out extremely quickly and does not require the application of any additional materials to the base paper 4. The integration of the embossing unit 10 into the cigarette assembly unit 11 means that ventilated cigarettes 1 can be manufactured in a single stage from an inexpensive low air permeability base paper 4, a bobbin of which can be loaded into the assembly machine 10 for sequential embossing and cigarette assembly.

For example, subsequent to the embossing process, the paper web 4 can be fed to a wrapping unit 19 to wrap a smokeable material. At a cutting unit 20, the continuous rod is cut in smaller rods 2 suitable to use in individual cigarettes. The rods 2 are used to form double length filter cigarettes as is known in the art. A double length filter at the centre of each double length cigarette can be cut in half to form a pair of individual cigarettes 1.

The embossing process can alternatively take place off-line, prior to the wrapper 4 being loaded into the cigarette assembly machine 11.

Although the invention is described above in relation to a cigarette 1, it will be appreciated that the invention is not limited to cigarettes but is applicable to other smoking articles.

The invention claimed is:

1. A smoking article comprising a rod of smokeable material and a single-sheet wrapper wrapped around the rod of smokeable material, wherein the single-sheet wrapper comprises at least one discrete region of ventilation embossing and at least one non-embossed region, the at least one discrete region of ventilation embossing having a gas diffusivity greater than a gas diffusivity of the remainder of the single-sheet wrapper, wherein the ventilation embossing overlaps the smokeable material and is located solely within a half of the single-sheet wrapper that is closest to a mouth end of the rod.

2. The smoking article according to claim 1, wherein the gas diffusivity is the carbon dioxide ($CO_2$) diffusivity.

3. The smoking article according to claim 1,
wherein the gas diffusivity of the at least one discrete region of ventilation embossing is at least 0.80 $cm^2/s$.

4. The smoking article according to claim 1,
wherein the gas diffusivity of the at least one discrete region of ventilation embossing is at least three times greater than the gas diffusivity of the remainder of the single-sheet wrapper.

5. The smoking article according to claim 1,
wherein the permeability of the at least one discrete region of ventilation embossing is higher than the permeability of the remainder of the single-sheet wrapper.

6. The smoking article according to claim 5, wherein the permeability of the at least one discrete region of ventilation embossing is between 30 CU and 75 CU.

7. The smoking article according to claim 1,
wherein the permeability of the at least one discrete region of ventilation embossing is at least one and a half times greater than the permeability of the remainder of the single-sheet wrapper.

8. The smoking article according to claim 1,
wherein the permeability of the at least one discrete region of ventilation embossing is at least twice the permeability of the remainder of the single-sheet wrapper.

9. The smoking article according to claim 1,
wherein the permeability of the at least one discrete region of ventilation embossing is at least three times greater than the permeability of the remainder of the single-sheet wrapper.

10. The smoking article according to claim 1, further comprising a filter attached to a mouth end of the rod of smokeable material.

11. The smoking article according to claim 10, wherein the at least one discrete region of ventilation embossing is configured to ventilate the filter via external gas entering the rod through the region of ventilation embossing and being drawn into the filter.

12. The smoking article according to claim 1, further comprising a tipping paper that does not comprise vent holes.

13. The smoking article according to claim 1,
wherein the single-sheet wrapper is a cigarette paper.

14. A method of forming a smoking article, comprising: embossing at least one discrete ventilation region in a single-sheet smoking article wrapper, the at least one discrete ventilation region having a gas diffusivity greater than a gas diffusivity of the remainder of the single-sheet smoking article wrapper; wrapping the single-sheet smoking article wrapper around a rod of smokeable material such that the at least one discrete ventilation region overlaps the smokeable material and is located solely within a half of the single-sheet smoking article wrapper that is closest to a mouth end of the rod.

15. A smoking article assembly unit configured to emboss at least one discrete ventilation region in a single-sheet smoking article wrapper and wrap the single-sheet smoking article wrapper around a rod of smokeable material such that the at least one discrete ventilation region overlaps the smokeable material solely within a half of the single-sheet smoking article wrapper that is closest to a mouth end of the rod.

16. The smoking article according to claim 1,
wherein the gas diffusivity of the at least one discrete region of ventilation embossing is at least five times greater than the gas diffusivity of the remainder of the single-sheet wrapper.

17. The smoking article according to claim 1,
wherein the gas diffusivity of the at least one discrete region of ventilation embossing is at least eight times greater than the gas diffusivity of the remainder of the single-sheet wrapper.

18. The smoking article according to claim 1,
wherein the gas diffusivity of the at least one discrete region of ventilation embossing is at least ten times greater than the gas diffusivity of the remainder of the single-sheet wrapper.

19. The smoking article according to claim 5,
wherein the permeability of the at least one discrete region of ventilation embossing is between 50 CU and 100 CU.

20. The smoking article according to claim 5,
wherein the permeability of the at least one discrete region of ventilation embossing is between 100 CU and 200 CU.

21. The smoking article according to claim 1,
wherein the permeability of the at least one discrete region of ventilation embossing is at least five times greater than the permeability of the remainder of the single-sheet wrapper.

22. The smoking article according to claim 1,
wherein the at least one discrete region of ventilation embossing covers 40% or less of the external surface of the single-sheet wrapper.

23. The smoking article according to claim 1,
wherein the at least one discrete region of ventilation embossing covers 30% or less of the external surface of the single-sheet wrapper.

24. The smoking article according to claim 1,
wherein the at least one discrete region of ventilation embossing covers 20% or less of the external surface of the single-sheet wrapper.

25. The smoking article according to claim 1,
wherein the at least one discrete region of ventilation embossing covers 10% or less of the external surface of the single-sheet wrapper.

* * * * *

UNITED STATES PATENT AND TRADEMARK OFFICE

CERTIFICATE OF CORRECTION

PATENT NO. : 9,125,436 B2
APPLICATION NO. : 13/882481
DATED : September 8, 2015
INVENTOR(S) : Leonardo Nappi It is certified that error appears in the above-identified patent and that said Letters Patent is hereby corrected as shown below:

Title Page 2, Item (56) References Cited
Foreign Patent Documents

"GB 1 277 443" should read --GB 1 277 449--

Signed and Sealed this
Nineteenth Day of January, 2016

Michelle K. Lee

Michelle K. Lee
*Director of the United States Patent and Trademark Office*